US008800122B2

(12) United States Patent
Pato

(10) Patent No.: US 8,800,122 B2
(45) Date of Patent: Aug. 12, 2014

(54) CREMAINS CONTAINMENT DEVICE

(71) Applicant: David William Pato, Perryopolis, PA (US)

(72) Inventor: David William Pato, Perryopolis, PA (US)

( * ) Notice: Subject to any disclaimer, the term of this patent is extended or adjusted under 35 U.S.C. 154(b) by 0 days.

(21) Appl. No.: 13/862,042

(22) Filed: Apr. 12, 2013

(65) Prior Publication Data

US 2013/0312235 A1 Nov. 28, 2013

Related U.S. Application Data

(60) Provisional application No. 61/650,853, filed on May 23, 2012.

(51) Int. Cl.
*A61G 17/00* (2006.01)

(52) U.S. Cl.
USPC ..... 27/1; 52/103; 52/134; 211/85.27

(58) Field of Classification Search
USPC ..... 27/1, 35; D99/5; 52/134, 136, 137, 103, 52/104; 211/85.27; 40/124.5
See application file for complete search history.

(56) References Cited

U.S. PATENT DOCUMENTS

| | | | | |
|---|---|---|---|---|
| 3,529,730 | A * | 9/1970 | Thompson | 211/85.27 |
| 3,654,675 | A * | 4/1972 | Peterson | 27/1 |
| 3,726,052 | A * | 4/1973 | Thompson | 52/103 |
| 5,832,575 | A * | 11/1998 | Sturino | 27/1 |
| 6,076,292 | A | 6/2000 | Kawa | |
| D434,201 | S | 11/2000 | Thesken | |
| 6,161,268 | A * | 12/2000 | Joseph | 27/35 |
| D452,058 | S | 12/2001 | Munroe-Browne | |
| 6,389,664 | B1 * | 5/2002 | Wood et al. | 27/1 |
| 6,463,703 | B1 * | 10/2002 | Mattis | 52/103 |
| 6,904,721 | B1 * | 6/2005 | Forbes | 52/103 |
| 7,171,733 | B2 * | 2/2007 | Min | 27/35 |
| 7,191,498 | B2 * | 3/2007 | Fischer | 27/1 |
| 7,703,185 | B2 * | 4/2010 | Trail | 27/1 |
| 7,739,776 | B2 * | 6/2010 | Hume | 27/35 |

* cited by examiner

*Primary Examiner* — William Miller

(57) ABSTRACT

A containment device for holding the remains of a cremated individual. The containment device may include a receptacle with a rim section and a containment section. A cap may be sealed on the receptacle once the remains of the cremated individual are within the containment section. The outside of the receptacle may include an attachment component. Therefore, the receptacle may be displayed in one's home for a time and then may be permanently mounted in a memorial site. An anchor may attach to the attachment component to prevent theft.

10 Claims, 5 Drawing Sheets

CREMAINS CONTAINMENT DEVICE

BACKGROUND OF THE INVENTION

The present invention relates to a cremains containment device, more particularly, to a cremains containment device that may be displayed in a home and permanently mounted in a memorial site.

Currently, a deceased person may be cremated or buried. When the deceased person is cremated, a family member may keep the ashes within an Urn or currently available containers. The family member may keep the Urn or receptacle for a period of time and may then want to dispose of it. Further, descendents of the family member may eventually receive the Urn or receptacle and may not know what to do with it. Most Urns or receptacles are not immune to the elements and may not be permanently mounted. Certain laws may prevent the disposal or scattering of the ashes. Therefore, it may be difficult for the decedents to dispose of the Urn or receptacle, or ashes in a respectful and honorable way.

If the family decides to cremate the deceased, the containers available may include urns, little (novelty) pet type caskets, enameled boxes with paintings and small figurines, cardboard painted packing tubes such as camouflage or other colors to mimic the personality of the deceased, and lastly the small cardboard or plastic box which provides little space for an epitaph, picture, or even the deceased's name.

As can be seen, there is a need for a cremation container that is diverse and may display memorable information to a viewer.

SUMMARY OF THE INVENTION

In one aspect of the present invention, a containment device for containing the remains of a cremation comprises: a body comprising a rim section and a containment section, wherein the containment section forms a cavity and the rim section forms an opening to the cavity; a cap configured to be sealed to the rim section; and an attachment component attached to the outside surface of the body, wherein the attachment component is configured to secure the body to an anchor.

These and other features, aspects and advantages of the present invention will become better understood with reference to the following drawings, description and claims.

DETAILED DESCRIPTION OF THE INVENTION

Figure 1:
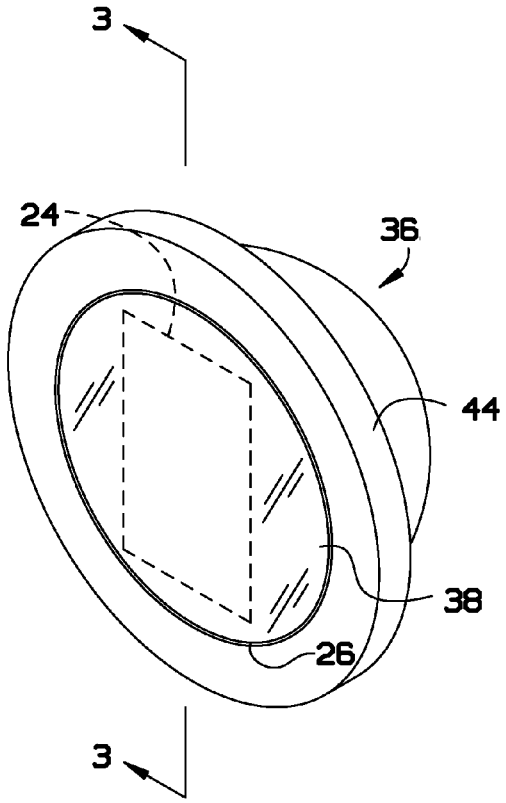
FIG. 1 is a perspective view of the present invention.
Figure 2:
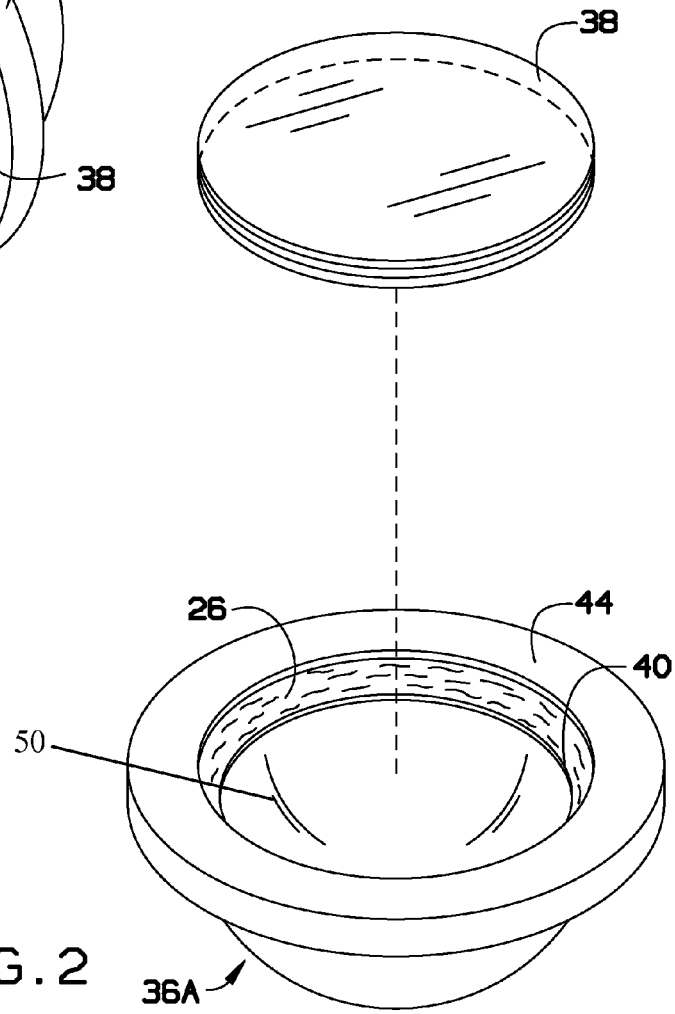
FIG. 2 is an exploded view of the present invention.
Figure 3:
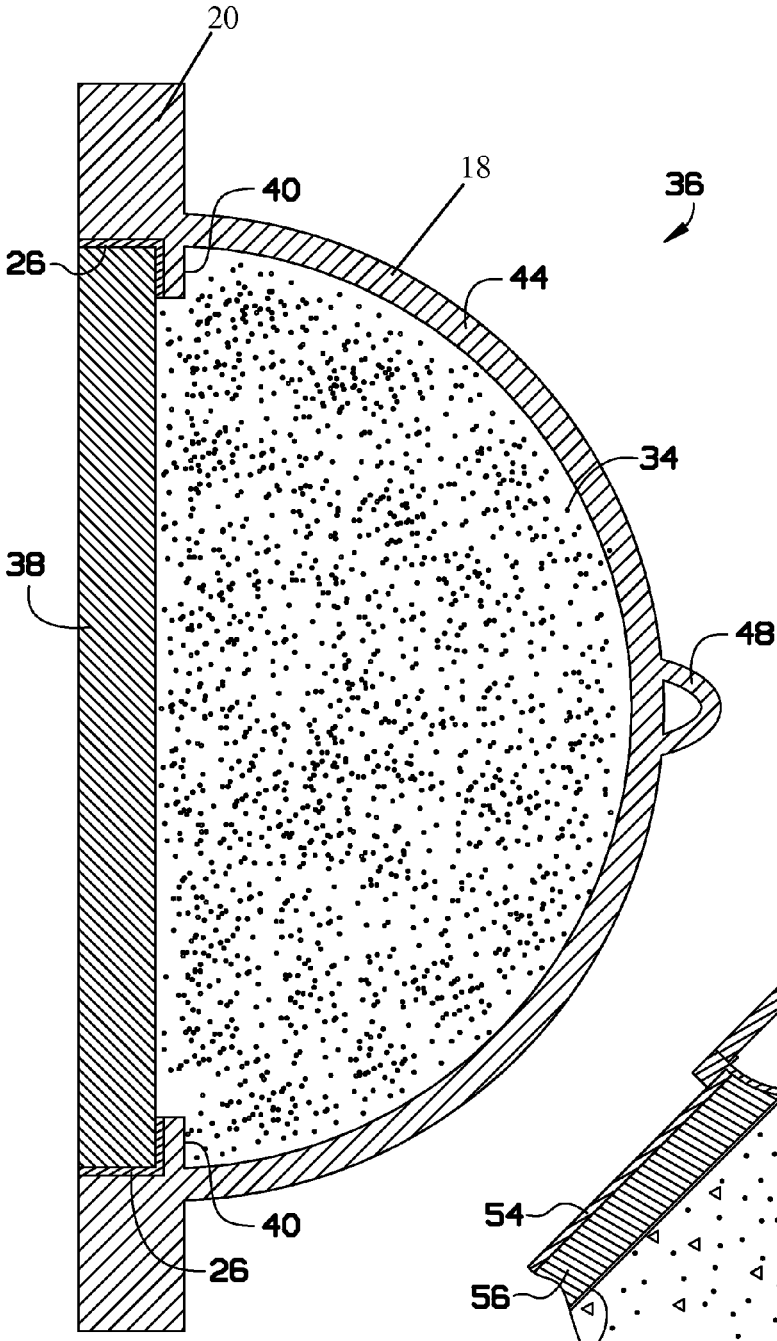
FIG. 3 is a section view of the present invention along line 3-3 in FIG. 1.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a containment device for containing the remains of a cremated individual. The containment device may include a receptacle with a rim section and a containment section. A cap may be sealed on the receptacle once the remains of the cremated individual are within the containment section. The outside of the receptacle may include an attachment component. Therefore, the receptacle may be displayed in one's home for a time and then may be permanently mounted in a memorial site. An anchor may attach to the attachment component to stabilize the device and prevent theft.

The present invention may include an alternative to standard cremation containers. The present invention may include options between mountings for display and ground level interment. The present invention may include a container for the ashes of the deceased. The container may provide both a permanent marker and a hermetically sealed, final resting place for the deceased.

The present invention provides dignity, security, and permanency to ash containment, providing a place to be heard and seen by the deceased since an epitaph and/or picture may be displayed. Further, the hermetically sealed container may comply with existing and future laws applying to location and non-contamination of the device. The container may provide for a transition of an indoor receptacle to an outdoor and a permanent location for the ashes. Therefore, future descendents may visit and pay respects to the cremated deceased.

Referring to FIGS. 1 through 9, the present invention may include a cremation container 36. The cremation container 36 may include a body 44. The body 44 may include a rim section 20 and a containment section 18. The containment section 18 of the body 44 may form a cavity 50 for the ashes 34 to be stored. The rim section 20 may form the opening of the containment section 18. In certain embodiments, the rim section 20 of the body 44 may further include a lip 40. The lip 40 may be adjacent to the containment section and protruding into the opening of the cavity. A cap 38 may be inserted into the rim section 20 and rest on the lip 40. In certain embodiments, to seal the cap 38 to the body 44, a sealant 24 may be used to seal the cap 38 to the rim section 20, such as the lip 40. The sealant 24 may be a UV resistant sealant 24.

In certain embodiments, the body 44 may be made of a strong and non-porous material. For example, the body 44 may be made of a strong polymer, a metal, or a combination thereof. The polymer may be an injection molded polymer, and may be UV and heat resistant. In certain embodiments, the entire body 44 may be made of a metal, such as a cast metal, or the entire body 44 may be made of a polymer. In certain embodiments, the containing section 18 may be made of the injection molded polymer and the rim section 20 may be made a cast metal. In certain embodiments, the containment section 18 may be made of a cast metal and the rim section 20 may be made of an injection molded polymer.

In certain embodiments, the cap 38 may be made of a clear material, such as glass, plastic, such as Plexi-glass® or Lexan®, or a combination thereof. In certain embodiments, the glass may be a thick and tinted glass. The cap 38 may be made of a thick or a layered glass and/or plastic. In certain embodiments, the cap 38 may include a text and image region 24. The text and image region 24 may include a writing and/or a picture. For example, the text may be a poem by the deceased and the picture may be a picture of the deceased. The text and image region 24 may be an embedded sheet, may be carved into the cap 38, may be attached to the bottom of the cap 38 if the cap 38 is clear, may be laser etched, or may be displayed using any suitable method.

The cap 38 may be shaped to fit within the rim section 20 of the body 44. As mentioned above, the cap 38 may be sealed to the rim section 20 using a sealant 26. In certain embodiments, a gasket may be used and may fit around the cap 38. In such embodiments, the cap 38 and the gasket may fit snuggly within the rim section 20 and rest against the lip 40. Sealant 26 may be injected into the gap between the cap 38 and the rim section 20. However, other methods may be implemented, such as lining the inside of the rim section with sealant 26 and inserting the cap 38.

In certain embodiments, the present invention may include an attachment component 48, such as a link. The attachment component 48 may protrude from the outer surface of the body 44. For example, the attachment component 48 may protrude from the bottom of the outer surface of the body 44. In certain embodiments, the cremation container 36 may be secured to the ground by an anchor 42. The anchor 42 may attach to the attachment component 48. The anchor 42 may include a connecting rod 60 that connects to the attachment component 48, a turnbuckle 68, and anchor rod 62. The anchor rod 62 may be secured to a concrete block 64, such as a poured cement mix. The connector rod 60, the anchor rod 62, and the turnbuckle 68 may be a metal, such as stainless steel. The poured cement mix may be used to secure a concrete preformed anchor 66 that may be pre cast and attached to the lower connector rod 62.

Figure 4:
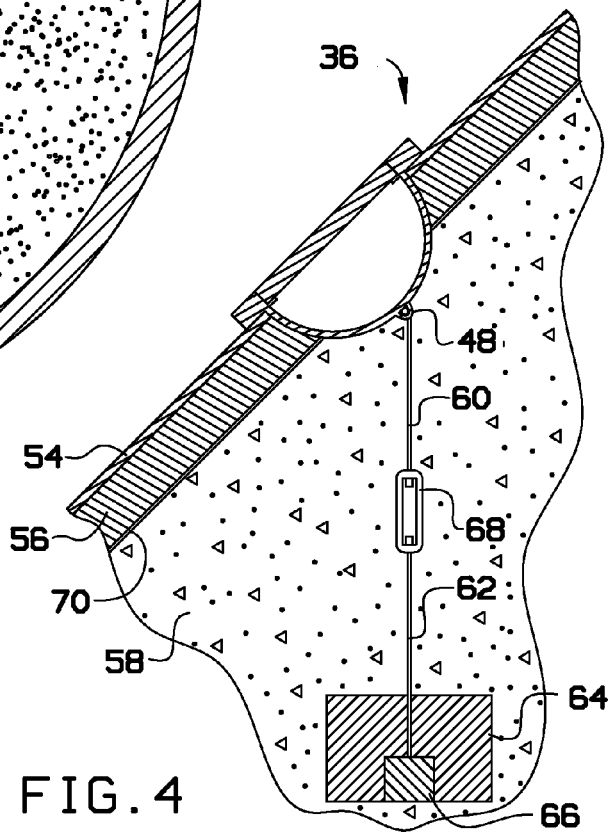
FIG. 4 is a section view of the present invention shown in use.
Figure 6:
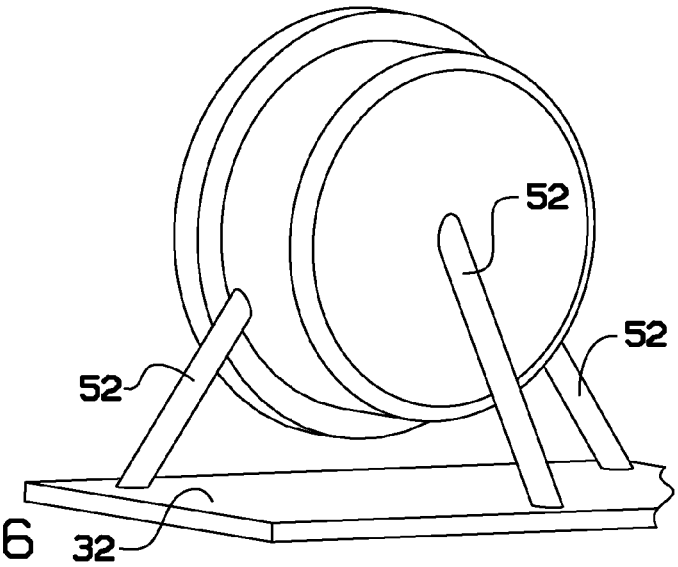
FIG. 6 is a perspective view of an alternate embodiment usage of the present invention.

As illustrated in FIG. 6, the cremation container 36 may be displayed in one's home, on a mantle 32. Legs 52 may be attached to the cremation container 36 to prop the cremation container 36 upward. When the family decides to permanently mount the cremation container 36, they may do so in many different ways. For example, the cremation container 36 may be inserted and secured to the ground by the anchor 42. As illustrated in FIG. 4, the cremation container 36 may be surrounded by grass 54 and may be within a compacted dirt layer 56 and a heavy landscape barrier 70. The anchor 42 may be within gravel 58 and may be secured to the concrete block 64. The anchor system presented may prevent or deter theft from occurring.

Figure 5:
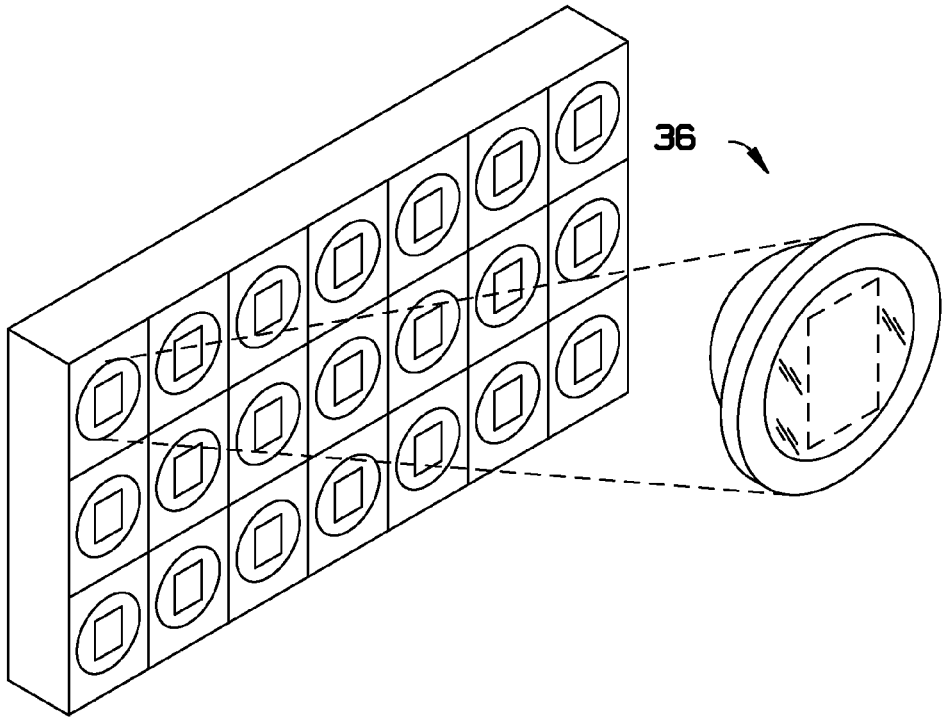
FIG. 5 is a perspective view of an alternate embodiment usage of the present invention.
Figure 7:
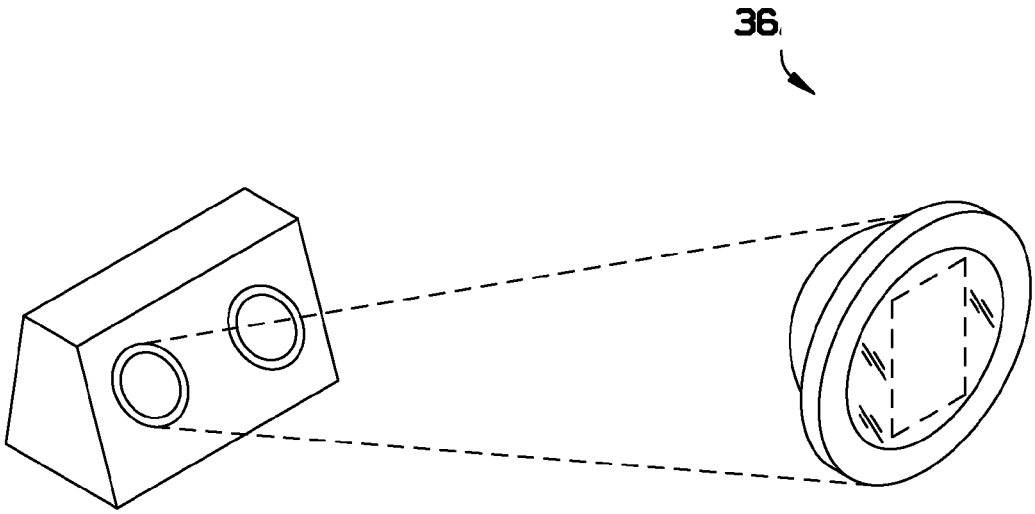
FIG. 7 is a perspective view of an alternate embodiment usage of the present invention.
Figure 8:
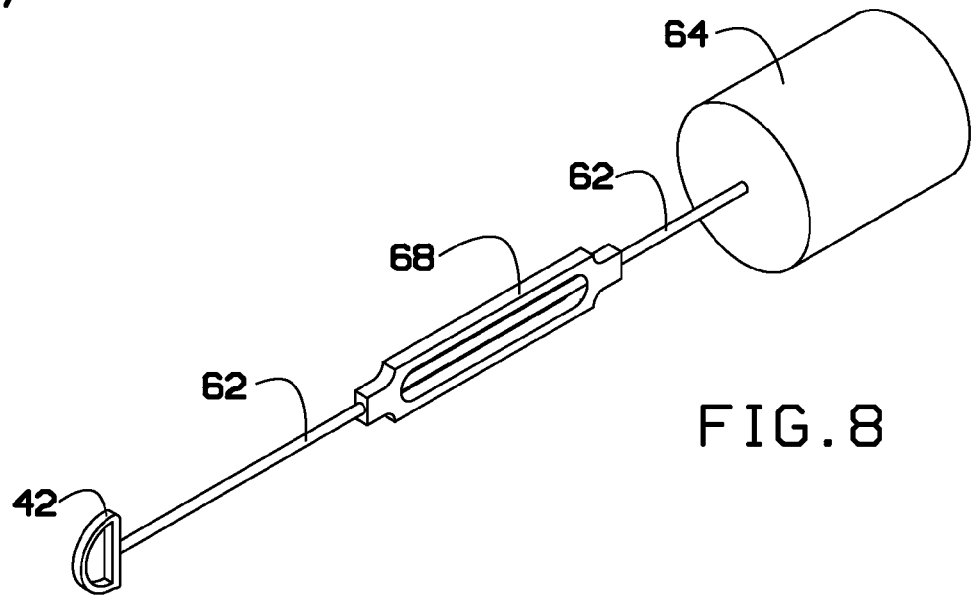
FIG. 8 is a perspective view of an anchor of the present invention.
Figure 9:
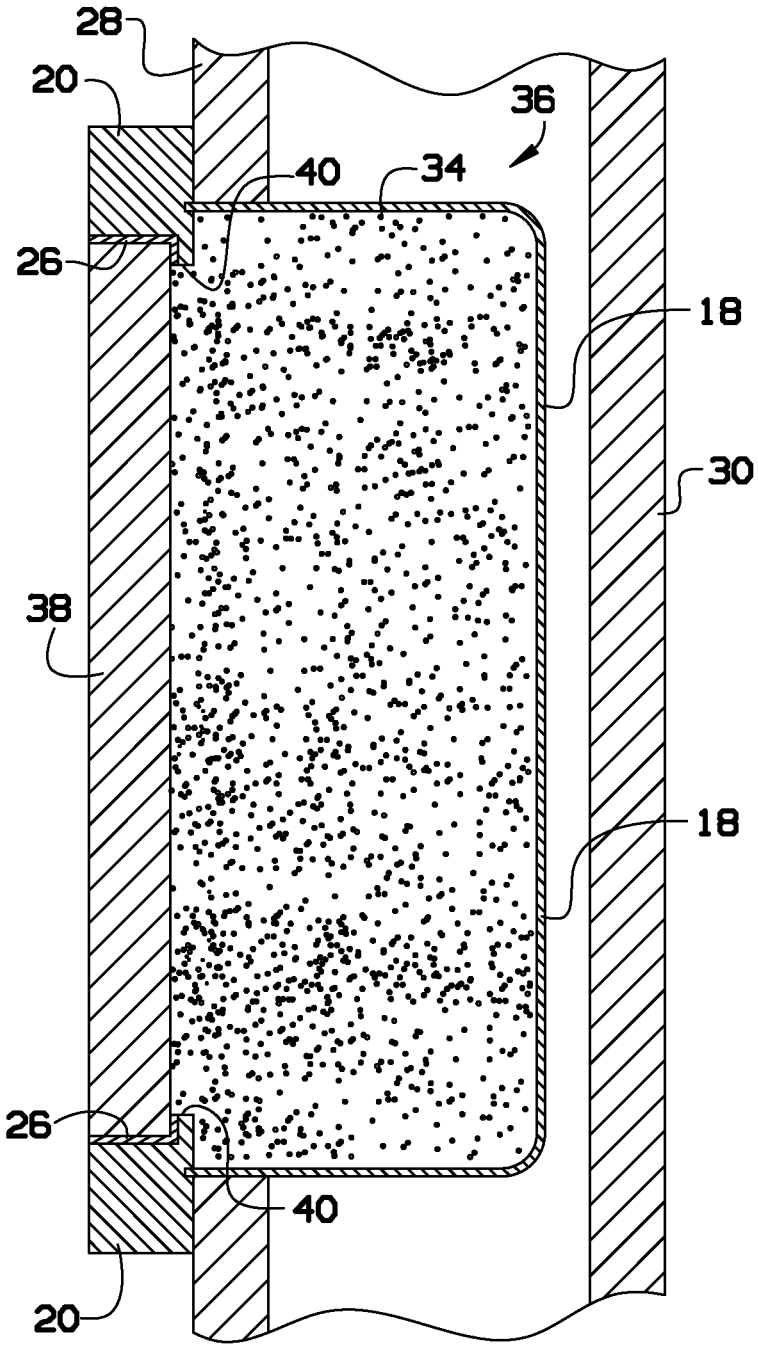
FIG. 9 is a section view of an alternate embodiment of the invention.

Other methods of mounting the present invention are illustrated in FIGS. 5, 7 and 9. As illustrated in FIGS. 5 and 9, the cremation container 36 may be mounted to a structure that may include a front wall 28 and a rear wall 30. For example, the present invention may be mounted to a memorial wall, such as a mausoleum. The body 44 of the cremation container 36 may be secured to the front wall 28 of the structure. As illustrated in FIG. 7, the present invention may also be inserted and secured to a headstone.

It should be understood, of course, that the foregoing relates to exemplary embodiments of the invention and that modifications may be made without departing from the spirit and scope of the invention as set forth in the following claims.

What is claimed is:

1. A cremation remains containment device comprising:

a body comprising a rim section and a containment section, wherein the containment section forms a cavity and the rim section forms an opening to the cavity for insertion of remains of a cremation therein;

a cap configured to be sealed to the rim section;

an attachment component on an outside surface of the body, wherein the attachment component comprises a hook shaped link forming an opening in between the outside surface of the body and the link; and an anchor connected to the hook shaped link, wherein the anchor comprises a rod and a solid block, wherein the rod comprises a first end and a second end, wherein the first end of the rod is secured to the hook shaped link and the second end of the rod is secured to the solid block.

2. The cremation remains containment device of claim 1, wherein the rim section comprises a lip adjacent to the containment section and protruding into the opening of the cavity.

3. The cremation remains containment device of claim 2, wherein the cap is formed to fit within rim section and rest on the lip.

4. The cremation remains containment device of claim 1, wherein the cap is permanently sealed within the rim section by a sealant.

5. The cremation remains containment device of claim 4, wherein the sealant hermetically seals the cap to the rim section.

6. The cremation remains containment device of claim 1, wherein the cap is made from a transparent material.

7. The cremation remains containment device of claim 6, wherein the transparent material is made from at least one of a glass and a plastic.

8. The cremation remains containment device of claim 1, wherein the body is made of at least one of a polymer and metal.

9. The cremation remains containment device of claim 1, wherein the cap further comprises a region for displaying at least one of text and image.

10. The cremation remains container device of claim 1, wherein the cap comprises a tinted glass, a tinted plastic, or a combination thereof.

* * * * *